US009158214B2

(12) United States Patent
Yoshimura et al.

(10) Patent No.: US 9,158,214 B2
(45) Date of Patent: Oct. 13, 2015

(54) ELECTROPHOTOGRAPHIC PHOTOSENSITIVE MEMBER, INTERMEDIATE TRANSFER MEMBER, PROCESS CARTRIDGE, AND ELECTROPHOTOGRAPHIC APPARATUS

(75) Inventors: Kimihiro Yoshimura, Yokohama (JP); Yohei Miyauchi, Tokyo (JP); Keiko Yamagishi, Kawasaki (JP); Kazuhisa Shirayama, Kawasaki (JP); Maho Hori, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/127,672

(22) PCT Filed: May 30, 2012

(86) PCT No.: PCT/JP2012/064495

§ 371 (c)(1),
(2), (4) Date: Dec. 19, 2013

(87) PCT Pub. No.: WO2012/176617

PCT Pub. Date: Dec. 27, 2012

(65) Prior Publication Data

US 2014/0113225 A1 Apr. 24, 2014

(30) Foreign Application Priority Data

Jun. 23, 2011 (JP) ..... 2011-139548
May 17, 2012 (JP) ..... 2012-113640

(51) Int. Cl.

| | |
|---|---|
| ***G03G 5/00*** | (2006.01) |
| ***G03G 7/00*** | (2006.01) |
| ***G03G 5/147*** | (2006.01) |
| ***G03G 15/16*** | (2006.01) |

(52) U.S. Cl.

CPC ..... *G03G 7/0053* (2013.01); *G03G 5/14704* (2013.01); *G03G 5/14734* (2013.01); *G03G 5/14773* (2013.01); *G03G 5/14795* (2013.01); *G03G 15/162* (2013.01); *G03G 2215/00957* (2013.01)

(58) Field of Classification Search

CPC ..... G03G 5/14704; G03G 5/047
USPC ..... 430/66, 58.05, 59.1; 399/159
See application file for complete search history.

(56) References Cited

U.S. PATENT DOCUMENTS

2006/0183041 A1 8/2006 Erk et al.
2007/0231721 A1 10/2007 Nukada

FOREIGN PATENT DOCUMENTS

EP 0747785 A2 12/1996
JP 08-220962 A 8/1996

(Continued)

*Primary Examiner* — Mark A Chapman
(74) *Attorney, Agent, or Firm* — Canon U.S.A. Inc., IP Division

(57) ABSTRACT

There are provided an electrophotographic photosensitive member and an intermediate transfer member each having good lubricity and good cleaning property on its surface, a process cartridge and an electrophotographic apparatus each including the electrophotographic photosensitive member, and an electrophotographic apparatus including the intermediate transfer member. Therefore, a surface layer of the electrophotographic photosensitive member or intermediate transfer member of the present invention contains a matrix component and a rotatably-retained spherical particle that is not bound with the matrix component and is rotatably retained in a pore in the matrix component.

16 Claims, 4 Drawing Sheets

(56) References Cited

FOREIGN PATENT DOCUMENTS

| | | | |
|---|---|---|---|
| JP | 8-262752 | A | 10/1996 |
| JP | 2002-116571 | A | 4/2002 |
| JP | 2004-302452 | A | 10/2004 |
| JP | 2005-043623 | A | 2/2005 |
| JP | 2005-156636 | A | 6/2005 |
| JP | 2006-178294 | A | 7/2006 |
| JP | 2007-057924 | A | 3/2007 |
| JP | 2007-072164 | A | 3/2007 |
| JP | 2007-328165 | A | 12/2007 |
| JP | 2008-090214 | A | 4/2008 |
| JP | 2008-276103 | A | 11/2008 |
| JP | 2009-151291 | A | 7/2009 |
| JP | 2010-237657 | A | 10/2010 |
| JP | 2011-64716 | A | 3/2011 |
| JP | 2011064716 | A | 3/2011 |

ELECTROPHOTOGRAPHIC PHOTOSENSITIVE MEMBER, INTERMEDIATE TRANSFER MEMBER, PROCESS CARTRIDGE, AND ELECTROPHOTOGRAPHIC APPARATUS

TECHNICAL FIELD

The present invention relates to an electrophotographic photosensitive member, a process cartridge and an electrophotographic apparatus each including the electrophotographic photosensitive member, an intermediate transfer member, and an electrophotographic apparatus including the intermediate transfer member.

BACKGROUND ART

In general, toner (transfer residual toner) or the like that is not completely transferred to a medium (e.g., paper sheet) is easily left, as an unwanted substance, on the surface of an electrophotographic photosensitive member or intermediate transfer member. Such an unwanted substance degrades image quality in the subsequent image forming process, and thus needs to be removed each time.

Transfer residual toner on the surface of an electrophotographic photosensitive member or intermediate transfer member is removed by, for example, a method in which an unwanted substance is scraped off by bringing a brush-shaped or blade-shaped cleaning member into contact with the surface of an electrophotographic photosensitive member or intermediate transfer member or a method in which an unwanted substance is removed by suction. In particular, a method that uses a blade-shaped cleaning member, that is to say, a cleaning blade has been widely used because cleaning can be effectively performed with a simple structure. The cleaning blade is often composed of rubber (particularly urethane rubber) that easily provides adhesion between the cleaning blade and the surface of an electrophotographic photosensitive member or intermediate transfer member.

However, rubber is a material having a high coefficient of friction. This causes an unusual sound (blade chattering), a decrease in the capability of scraping toner due to vibration of a cleaning blade (passing toner), and a phenomenon in which a cleaning blade curls (blade curling).

PTL 1 discloses a method in which a fluorine-based or silicone-based solid lubricating component is applied to a cleaning blade to decrease the friction between the cleaning blade and an electrophotographic photosensitive member.

PTL 9 discloses a method in which a solid lubricating component is applied to a cleaning blade to decrease the friction between the cleaning blade and an intermediate transfer member.

PTLs 2 and 3 disclose methods in which a fluorocarbon resin component is contained in a surface layer of an electrophotographic photosensitive member. PTL 4 discloses a method in which a silicone resin component is contained in a surface layer of an electrophotographic photosensitive member.

PTLs 5 and 6 disclose methods in which lubricity and cleaning property are improved by forming projections and depressions on the surface of an electrophotographic photosensitive member.

PTLs 7 and 8 disclose methods in which the coefficient of friction is decreased by incorporating inorganic particles in a surface layer of an electrophotographic photosensitive member.

CITATION LIST

Patent Literature

PTL 1 Japanese Patent Laid-Open No. 08-220962
PTL 2 Japanese Patent Laid-Open No. 2005-043623
PTL 3 Japanese Patent Laid-Open No. 2008-090214
PTL 4 Japanese Patent Laid-Open No. 2007-072164
PTL 5 Japanese Patent Laid-Open No. 2004-302452
PTL 6 Japanese Patent Laid-Open No. 2010-237657
PTL 7 Japanese Patent Laid-Open No. 8-262752
PTL 8 Japanese Patent Laid-Open No. 2002-116571
PTL 9 Japanese Patent Laid-Open No. 2008-276103

SUMMARY OF INVENTION

Technical Problem

However, the technologies disclosed in PTLs 1 to 9 still have room for improvement in terms of the lubricity and cleaning property of the surface of an electrophotographic photosensitive member or intermediate transfer member.

Specifically, in the technologies disclosed in PTLs 1 and 9, when an image is repeatedly formed, the solid lubricating component is detached from the cleaning blade. Therefore, it is difficult to maintain, for a long time, an effect of decreasing the friction between the cleaning blade and the electrophotographic photosensitive member or intermediate transfer member.

In the technologies disclosed in PTLs 2 and 3, the fluorocarbon resin component is easily altered through a charging process of an electrophotographic photosensitive member. Therefore, when an image is repeatedly formed, an effect of decreasing the friction between the cleaning blade and the electrophotographic photosensitive member is easily eliminated.

In the technology disclosed in PTL 4, the silicone resin component is unevenly present on the surface side in the surface layer of an electrophotographic photosensitive member. Therefore, when an image is repeatedly formed, the silicone resin component is removed, and an effect of decreasing the friction between the cleaning blade and the electrophotographic photosensitive member is easily eliminated.

In the technologies disclosed in PTLs 5 and 6, when an image is repeatedly formed, the projections and depressions on the surface of an electrophotographic photosensitive member are removed and thus an effect of decreasing the friction between the cleaning blade and the electrophotographic photosensitive member is easily eliminated.

In the technologies disclosed in PTLs 7 and 8, inorganic particles having hardness higher than that of rubber used for a cleaning blade are fixed by being bound with a matrix component in the surface layer of an electrophotographic photosensitive member. Therefore, when an image is repeatedly formed, an edge of the cleaning blade is easily chipped and toner easily passes through the chipped portion.

The present invention provides an electrophotographic photosensitive member and an intermediate transfer member each having good lubricity (low friction) and good cleaning property on its surface, a process cartridge and an electrophotographic apparatus each including the electrophotographic photosensitive member, and an electrophotographic apparatus including the intermediate transfer member.

Solution to Problem

The present invention provides an electrophotographic photosensitive member including a surface layer containing a matrix component and a rotatably-retained spherical particle that is not bound with the matrix component and is rotatably retained in a pore in the matrix component.

The present invention also provides a process cartridge detachably attached to a main body of an electrophotographic apparatus, the process cartridge integrally supporting the electrophotographic photosensitive member above and a cleaning unit including a cleaning blade that is in contact with a surface of the electrophotographic photosensitive member.

The present invention also provides an electrophotographic apparatus including the electrophotographic photosensitive member above, a charging unit, an image exposure unit, a developing unit, a transfer unit, and a cleaning unit including a cleaning blade that is in contact with a surface of the electrophotographic photosensitive member.

The present invention also provides an intermediate transfer member including a surface layer containing a matrix component and a rotatably-retained spherical particle that is not bound with the matrix component and is rotatably retained in a pore in the matrix component.

The present invention also provides an electrophotographic apparatus including an electrophotographic photosensitive member, an image exposure unit, a developing unit, a first transfer unit, the intermediate transfer member above, a second transfer unit, and a cleaning unit including a cleaning blade that is in contact with a surface of the intermediate transfer member.

Advantageous Effects of Invention

According to the present invention, there can be provided an electrophotographic photosensitive member and an intermediate transfer member each having good lubricity and good cleaning property on its surface, a process cartridge and an electrophotographic apparatus each including the electrophotographic photosensitive member, and an electrophotographic apparatus including the intermediate transfer member.

DESCRIPTION OF EMBODIMENT

As a result of eager study conducted by the inventors of the present invention, the inventors have found that "the principle of the driven roller" is effectively used as a method for improving the lubricity of a surface of an electrophotographic photosensitive member or intermediate transfer member. Specifically, they have confirmed that, by disposing spherical particles in a contact portion between a cleaning blade and an electrophotographic photosensitive member or intermediate transfer member (hereinafter may be simply referred to as "contact portion"), a stable sliding state can be achieved for the cleaning blade. However, if the spherical particles are only disposed in the contact portion, the spherical particles will be scattered due to repeated formation of images and thus a lubricating effect will not be sufficiently maintained.

Figure 1:
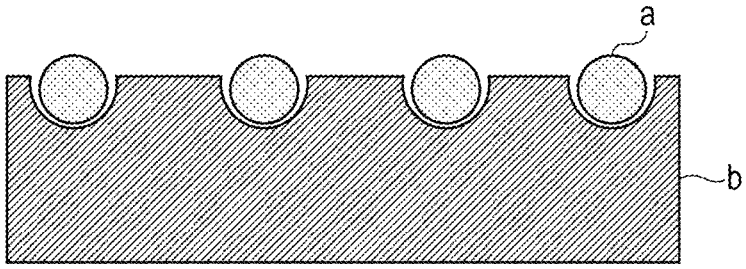
FIG. 1 shows an example of a state in which a matrix component and rotatably-retained spherical particles are contained in a surface layer of an electrophotographic photosensitive member or intermediate transfer member.

The inventors have found that a structure in which the surface of an electrophotographic photosensitive member or intermediate transfer member is brought into a state shown in FIG. 1 during the formation of images is effective for maintaining a state in which spherical particles roll in the contact portion while suppressing the scattering of the spherical particles from the contact portion. In FIG. 1, spherical particles are rotatably retained in pores of a matrix component in a surface layer of an electrophotographic photosensitive member or intermediate transfer member, and the spherical particles are not bound with the matrix component in the surface layer. The spherical particles in such a state are referred to as "rotatably-retained spherical particles" in the present invention. In FIG. 1, the rotatably-retained spherical particles are (partly) exposed on the surface of the electrophotographic photosensitive member or intermediate transfer member.

In such a state, the lubricity of the surface of the electrophotographic photosensitive member or intermediate transfer member is provided by the principle of the driven roller (the rolling motion of rotatably-retained spherical particles exposed on the surface of the electrophotographic photosensitive member or intermediate transfer member). Furthermore, when the opening diameter of each of the pores that rotatably retains a particular rotatably-retained spherical particle is smaller than or equal to the diameter (Dp) of the particular rotatably-retained spherical particle, the scattering of the rotatably-retained spherical particles is suppressed and the lubricity of the surface of the electrophotographic photosensitive member or intermediate transfer member is maintained.

As the surface layer of the electrophotographic photosensitive member or intermediate transfer member is worn due to repeated formation of images, the opening diameter of each of the pores exceeds the diameter (Dp) of the corresponding rotatably-retained spherical particle sooner or later. Consequently, the rotatably-retained spherical particles are easily detached from the surface layer of the electrophotographic photosensitive member or intermediate transfer member, and the rotatably-retained spherical particles are easily scattered.

Figure 3:
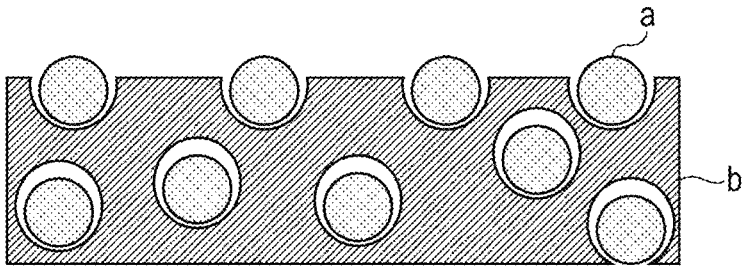
FIG. 3 shows an example of a state in which a matrix component and rotatably-retained spherical particles are contained in the surface layer of the electrophotographic photosensitive member or intermediate transfer member.

In order to address a problem in that the surface layer of the electrophotographic photosensitive member or intermediate transfer member is worn due to repeated formation of images, the configuration shown in FIG. 3 can be employed. That is, there are not only rotatably-retained spherical particles that are exposed on the surface of the electrophotographic photosensitive member or intermediate transfer member, but also rotatably-retained spherical particles that are not exposed on the surface of the electrophotographic photosensitive member or intermediate transfer member and that are present inside the surface layer. In such a state, even if the surface layer of the electrophotographic photosensitive member or intermediate transfer member is worn, the lubricity of the surface of the electrophotographic photosensitive member or intermediate transfer member is maintained as long as the rotatably-retained spherical particles are present in the surface layer.

The rotatably-retained spherical particles that are present inside the surface layer may be exposed on the surface of the electrophotographic photosensitive member or intermediate transfer member through the wear of the surface layer of the electrophotographic photosensitive member or intermediate transfer member, the wear being caused due to formation of images. In this case, the rotatably-retained spherical particles are not necessarily exposed on the surface of the electrophotographic photosensitive member or intermediate transfer member at the beginning of formation of images.

Figure 2:
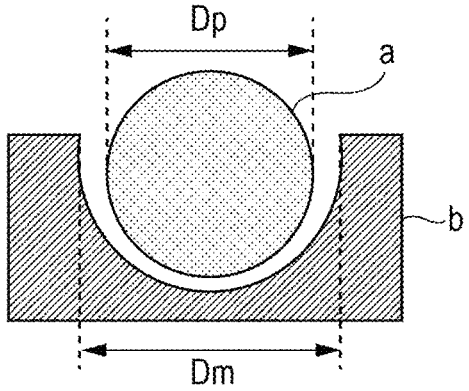
FIG. 2 is an enlarged view of a rotatably-retained spherical particle contained in the surface layer of the electrophotographic photosensitive member or intermediate transfer member.
Figure 4:
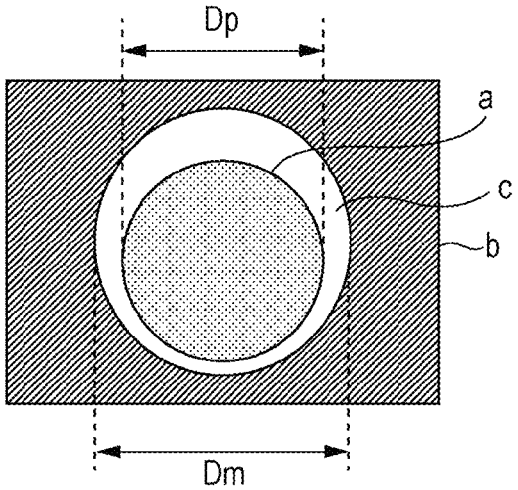
FIG. 4 is an enlarged view of a rotatably-retained spherical particle contained in the surface layer of the electrophotographic photosensitive member or intermediate transfer member.

FIGS. 2 and 4 are enlarged views of a rotatably-retained spherical particle contained in the surface layer of the electrophotographic photosensitive member or intermediate transfer member.

FIGS. 1 to 4 show the rotatably-retained spherical particles a and the matrix component b. In the drawings, Dp indicates the diameter of each of the rotatably-retained spherical particles and Dm indicates the diameter of each of the pores in the matrix component that rotatably retains the rotatably-retained spherical particles.

A value of (Dm−Dp)/Dp is defined as a porosity. In the surface layer of the electrophotographic photosensitive member or intermediate transfer member, the ratio of the number of pairs of a rotatably-retained spherical particle and a pore having a porosity of 0.05 to 0.65 relative to the total number of pairs of a rotatably-retained spherical particle and a pore is preferably 40 to 100%. If the porosity is excessively low, it becomes difficult for the rotatably-retained spherical particles to smoothly roll even when the rotatably-retained spherical particles are exposed on the surface of the electrophotographic photosensitive member or intermediate transfer member. If the porosity is excessively high, the opening diameter of each of the pores exceeds the diameter (Dp) of the corresponding rotatably-retained spherical particle even when the surface layer of the electrophotographic photosensitive member or intermediate transfer member is only slightly worn. Consequently, the rotatably-retained spherical particles are easily detached from the surface layer of the electrophotographic photosensitive member or intermediate transfer member.

The diameter (Dp) of each of the rotatably-retained spherical particles is preferably 0.3 to 10 μm. If the diameter of each of the rotatably-retained spherical particles is excessively small, the height of a portion, of the rotatably-retained spherical particle, that protrudes from the surface of the electrophotographic photosensitive member or intermediate transfer member in the state shown in FIG. 1 is decreased. In this case, since a cleaning blade is further brought into intimate contact with the surface of the electrophotographic photosensitive member or intermediate transfer member due to its elastic deformation, a sufficient lubricating effect is sometimes not achieved. If the diameter of the rotatably-retained spherical particle is excessively large, the height of a portion, of the rotatably-retained spherical particle, that protrudes from the surface of the electrophotographic photosensitive member or intermediate transfer member is increased and thus toner particles easily pass through a gap between a cleaning blade and the surface of the electrophotographic photosensitive member or intermediate transfer member. Therefore, in the surface layer of the electrophotographic photosensitive member or intermediate transfer member, the ratio of the number of rotatably-retained spherical particles having a diameter of 0.3 to 10 μm relative to the total number of rotatably-retained spherical particles is preferably 50 to 100%.

A gap between the outer surface of each of the rotatably-retained spherical particles and the inner surface of the corresponding pore in the matrix component can be filled with a liquid in order to suppress the entry, into the gap, of external additives of toner, paper dust, and shavings from the electrophotographic photosensitive member or intermediate transfer member. If such external additives, paper dust, and shavings enter the gap, it may become difficult for the rotatably-retained spherical particles to smoothly roll.

The viscosity of the liquid with which the gap is filled is preferably 100 to 10000 cs. If the viscosity of the liquid is excessively high, it may become difficult for the rotatably-retained spherical particles to smoothly roll due to the viscosity resistance of the liquid. If the viscosity of the liquid is excessively low, the liquid easily flows out from the gap.

A colorless pH-neutral liquid having poor solubility in water and insulating property can be used as the liquid with which the gap is filled. Specific examples of the liquid include fluorine-based oil, silicone oil, poly-α-olefin oil, polyol ester, phenyl ether, liquid paraffin, polybutene, and alkyl aromatic compounds. Among them, silicone oil and fluorine-based oil can be particularly used.

Colorless particles having insulating property can be used as the rotatably-retained spherical particles. Specific examples of the rotatably-retained spherical particles include inorganic particles composed of silicon oxide, titanium oxide, zirconium oxide, aluminum oxide, calcium carbonate, calcium hydrogen phosphate, or aluminum nitride; organic particles composed of cross-linked polystyrene, cross-linked acrylic resin, phenolic resin, melamine resin, polyethylene, polypropylene, or fluorocarbon resin; and organic/inorganic hybrid particles. Among them, inorganic particles and organic/inorganic hybrid particles that are not easily deformed or broken due to high pressure or electric discharge can be particularly used. Polymethylsilsesquioxane particles can be used as the organic/inorganic hybrid particles. Silica particles can be used as the inorganic particles.

These rotatably-retained spherical particles may be used alone or in combination.

The rotatably-retained spherical particles can be subjected to surface modification to improve the dispersibility in the formation of a surface layer and adjust the gap between the rotatably-retained spherical particles and the matrix component. Specifically, the surface modification can be performed by a method in which a coupling agent or a siloxane compound is bonded to the surface of each of the rotatably-retained spherical particles using a functional group on the surface, such as a hydroxyl group or an amino group, or a method in which a molecular chain is extended from the surface of each of the rotatably-retained spherical particles using a polymerizable monomer. Examples of the coupling agent include silane coupling agents and titanate coupling agents each having an organic functional group.

By using the following method, the rotatably-retained spherical particles can be incorporated into the surface layer while not being bound with the matrix component. That is, a film is formed using a surface layer coating solution that contains rotatably-retained spherical particles and a matrix component. Subsequently, a liquid that dissolves the rotatably-retained spherical particles to a greater extent than the matrix component is applied to the film to decrease the diameter of each of the rotatably-retained spherical particles. Specifically, titanium oxide (titania) particles, silicon oxide (silica) particles, zirconium oxide (zirconia) particles, and organic/inorganic hybrid particles having a siloxane bond such as polymethylsilsesquioxane particles are soluble in hydrofluoric acid or an aqueous sodium hydroxide solution. Therefore, when such particles are used, rotatably-retained spherical particles can be incorporated into the surface layer while not being bound with the matrix component by selecting, as the matrix component, a material having resistance to a solvent such as hydrofluoric acid or an aqueous sodium hydroxide solution.

In the case where the rotatably-retained spherical particles are made to swell by a solvent having low volatility, a film of the surface layer coating solution that contains rotatably-retained spherical particles and a matrix component is formed. A solvent that is dissolving the matrix component is volatilized, and then a solvent that is causing the rotatably-retained spherical particles to swell is volatilized to decrease the diameter of each of the rotatably-retained spherical particles. When the film of the surface layer coating solution is dried at high temperature, rotatably-retained spherical particles can be incorporated into the surface layer while not being bound with the matrix component by using the difference in volumetric shrinkage during cooling between the matrix component and the rotatably-retained spherical particles.

When the surface energy of the matrix component is significantly different from that of the rotatably-retained spherical particles, a low-molecular-weight compound having a high affinity for the rotatably-retained spherical particles may be added as a third substance. In this case, the third substance aggregates around each of the rotatably-retained spherical particles and may form a film structure. A solvent that selectively elutes the third substance is applied to the film composed of the third substance to elute the film, whereby rotatably-retained spherical particles can be incorporated into the surface layer while not being bound with the matrix component. Specifically, when cross-linked polystyrene particles having low polarity are dispersed in a resin having relatively high polarity, such as polyester, a low-molecular-weight surfactant having a phenyl group with an alkyl group and an ethylene oligomer unit is mixed therein. After a film is formed, the surface of the film is immersed in an alcohol solvent that dissolves only the surfactant, whereby a gap can be made around each of the cross-linked polystyrene particles.

Inorganic oxide particles are selected as the rotatably-retained spherical particles, and a silicone component having a Si—H bond is caused to react with a hydroxyl group on the surface of each of the inorganic oxide particles. Consequently, inorganic particles modified with silicone can be obtained. Furthermore, by separately adding a silicone oil to a surface layer coating solution that contains the obtained inorganic particles and a matrix component, rotatably-retained spherical particles can be incorporated into the surface layer while not being bound with the matrix component.

The layer structure of an electrophotographic photosensitive member will now be described.

An electrophotographic photosensitive member generally includes a support and a photosensitive layer formed on the support.

The photosensitive layer may be a single-layer photosensitive layer obtained by incorporating a charge transporting substance and a charge generating substance in the same layer or a laminated photosensitive layer obtained by stacking a charge generating layer containing a charge generating substance and a charge transporting layer containing a charge transporting substance. The laminated photosensitive layer may be a normal order-type photosensitive layer obtained by stacking a charge generating layer and a charge transporting layer in that order from the support side or a reverse order-type photosensitive layer obtained by stacking a charge transporting layer and a charge generating layer in that order from the support side.

A protective layer may be formed on the photosensitive layer. The protective layer may contain conductive particles such as conductive metal oxide particles.

The surface layer of the electrophotographic photosensitive member is a layer located on the outermost surface side of the electrophotographic photosensitive member (a layer located farthest from the support, a layer having a surface on which toner is carried). For example, in the case where a protective layer is formed, the surface layer of the electrophotographic photosensitive member is a protective layer. In the case where a protective layer is not formed and the photosensitive layer is a single-layer photosensitive layer, the surface layer of the electrophotographic photosensitive member is a single-layer photosensitive layer. In the case where a protective layer is not formed and the photosensitive layer is a normal order-type photosensitive layer, the surface layer of the electrophotographic photosensitive member is a charge transporting layer. In the case where a protective layer is not formed and the photosensitive layer is a reverse order-type photosensitive layer, the surface layer of the electrophotographic photosensitive member is a charge generating layer.

The support can be composed of a material having conductivity (conductive support). Examples of the support include supports composed of a metal such as aluminum, nickel, copper, gold, or iron or an alloy of the foregoing; supports obtained by forming a thin film composed of a conductive material such as a metal, e.g., aluminum, silver, and gold, indium oxide, or tin oxide on an insulating support composed of polyester, polycarbonate, polyimide, or glass; and supports obtained by dispersing carbon black or a conductive filler in a resin to impart conductivity.

The surface of the support can be subjected to an electrochemical treatment such as anodic oxidation to improve electrical characteristics and adhesion. The surface of the support can also be subjected to a chemical treatment with a solution obtained by dissolving a metal salt compound or a metal salt of a fluorine compound in an acid aqueous solution mainly composed of an alkali phosphate, phosphoric acid, or tannic acid.

In the case where single-wavelength light such as a laser beam is used as image exposure light, the surface of the support can be roughened to suppress interference fringes. Specifically, the surface of the support can be roughened by being subjected to a treatment such as honing, blasting, cutting, or electrolytic polishing or by forming a conductive film composed of a conductive metal oxide and a binder resin on the surface of the support.

The honing treatment includes a dry honing treatment and a wet honing treatment. The wet honing treatment is a method for roughening the surface of the support by suspending a powdery abrasive in a liquid such as water and blowing the suspension onto the surface of the support at high speed. The surface roughness of the support can be controlled in accordance with, for example, blowing pressure, blowing speed, the amount, type, shape, size, hardness, and specific gravity of the abrasive, and suspension temperature. The dry honing treatment is a method for roughening the surface of the support by blowing an abrasive onto the surface of the support at high speed using air. The surface roughness of the support can be controlled in the same manner as that of the wet honing treatment. Examples of the abrasive used in the honing treatment include particles of silicon carbide, alumina, iron, and glass.

A conductive layer may be formed between the support and the photosensitive layer or an undercoating layer described below to suppress interference fringes caused when single-wavelength light such as a laser beam is used and to cover scratches formed on the surface of the support.

The conductive layer can be formed by applying a conductive layer coating solution prepared by dispersing conductive particles such as carbon black, metal particles, or metal oxide particles together with a binder resin and a solvent and then drying and curing the resultant film. Examples of the metal oxide particles include zinc oxide particles and titanium oxide particles. Barium sulfate particles can also be used as the conductive particles. The conductive particles may be composite particles including core particles and a covering layer formed on each of the core particles.

The volume resistivity of the conductive particles is preferably 0.1 to 1000 Ω·cm and more preferably 1 to 1000 Ω·cm. The volume resistivity is measured with Resistivity meter Loresta AP manufactured by Mitsubishi Petrochemical Co., Ltd. A sample used for this measurement is prepared by compacting, at a pressure of 49 MPa, conductive particles into a coin-like shape.

The average particle size of the conductive particles is preferably 0.05 to 1.0 μm and more preferably 0.07 to 0.7 μm. The average particle size is measured by centrifugal sedimentation.

The content of the conductive particles in the conductive layer is preferably 1 to 90% by mass and more preferably 5 to 80% by mass relative to the total mass of the conductive layer.

Examples of the binder resin used for the conductive layer include phenolic resin, polyurethane, polyamide, polyimide, polyamide-imide, polyvinyl acetal, epoxy resin, acrylic resin, melamine resin, and polyester. These binder resins may be used alone or in combination as a mixture or a copolymer. Among them, phenolic resin, polyurethane, and polyamide are particularly used because they have good adhesion to the support, high dispersibility with the conductive particles, and high solvent resistance after the formation of the conductive layer.

The thickness of the conductive layer is preferably 0.1 to 30 μm and more preferably 0.5 to 20 μm.

The volume resistivity of the conductive layer is preferably $10^{13}$ Ω·cm or less and more preferably $10^{5}$ to $10^{12}$ Ω·cm. The volume resistivity is determined by the following method. That is, a film is formed on an aluminum sheet using the same material as that of the conductive layer to be measured. A gold thin film is formed on the film and an electric current that flows between the aluminum sheet and the gold thin film is measured with a pA meter.

A leveling agent may be added to the conductive layer to improve the surface properties of the conductive layer.

An undercoating layer (also called intermediate layer) having a barrier function and an adhesive function may be formed between the support or the conductive layer and the photosensitive layer (charge generating layer, charge transporting layer). The undercoating layer is formed, for example, to improve the adhesion of the photosensitive layer, improve coatability, improve charge injection from the support, and protect the photosensitive layer from electrical breakdown.

The undercoating layer can be formed by applying an undercoating layer coating solution prepared by dissolving a resin in a solvent and then drying the resultant film.

Examples of the resin used for the undercoating layer include acrylic resin, allyl resin, alkyd resin, ethyl cellulose resin, ethylene-acrylic acid copolymers, epoxy resin, casein resin, silicone resin, gelatin resin, phenolic resin, butyral resin, polyacrylate, polyacetal, polyamide-imide, polyamide, polyallyl ether, polyimide, polyurethane, polyester, polyethylene, polycarbonate, polystyrene, polysulfone, polyvinyl alcohol, polybutadiene, polypropylene, and urea resin. The undercoating layer may also be formed of aluminum oxide or the like.

The thickness of the undercoating layer is preferably 0.05 to 5 μm and more preferably 0.3 to 3 μm.

A photosensitive layer is formed on the support, the conductive layer, or the undercoating layer.

In the case where the photosensitive layer is a laminated photosensitive layer, the charge generating layer can be formed by applying a charge-generating-layer coating solution prepared by dispersing a charge generating substance together with a binder resin and a solvent and then drying the resultant film.

The ratio of the charge generating substance to the binder resin is preferably 1:0.3 to 1:4 by mass.

The dispersion can be performed by a method that uses, for example, a homogenizer, an ultrasonic disperser, a ball mill, a vibration ball mill, a sand mill, an attritor, a roll mill, or a liquid collision high speed disperser.

Examples of the charge generating substance include dyes and pigments such as selenium-tellurium, pyrylium, thiapyrylium, phthalocyanine, anthanthrone, dibenzpyrenequinone, cyanine, trisazo, bisazo, monoazo, indigo, quinacridone, and asymmetric quinocyanine. Among them, a phthalocyanine pigment is particularly used. Examples of the phthalocyanine pigment include oxytitanium phthalocyanine, chlorogallium phthalocyanine, dichlorotin phthalocyanine, and hydroxygallium phthalocyanine.

Examples of the binder resin used for the charge generating layer include acrylic resin, methacrylic resin, allyl resin, alkyd resin, epoxy resin, diallyl phthalate resin, silicone resin, styrene-butadiene copolymers, cellulose resin, phenolic resin, butyral resin, benzal resin, melamine resin, polyacrylate, polyacetal, polyamide-imide, polyamide, polyallyl ether, polyarylate, polyimide, polyurethane, polyester, polyethylene, polycarbonate, polystyrene, polysulfone, polyvinyl acetal, polyvinyl methacrylate, polyvinyl acrylate, polybutadiene, polypropylene, urea resin, vinyl chloride-vinyl acetate copolymers, vinyl acetate resin, and vinyl chloride resin. Among them, butyral resin is particularly used. These binder resins may be used alone or in combination as a mixture or a copolymer.

Examples of the solvent used for the charge-generating-layer coating solution include alcohols, sulfoxides, ketones, ethers, esters, aliphatic halogenated hydrocarbons, and aromatic compounds.

The thickness of the charge generating layer is preferably 0.01 to 5 μm, more preferably 0.01 to 2 μm, and further preferably 0.05 to 0.3 μm.

A sensitizer, an antioxidant, an ultraviolet absorber, a plasticizer, an electron-conveying agent, and the like may be added to the charge generating layer.

In the case where the photosensitive layer is a laminated photosensitive layer, the charge transporting layer can be formed by applying a charge-transporting-layer coating solution prepared by dissolving a charge transporting substance and a binder resin in a solvent and then drying the resultant film. When the charge transporting layer is a surface layer, the above-described rotatably-retained spherical particles and the like are added to the charge-transporting-layer coating solution.

Examples of the charge transporting substance include triarylamine compounds, hydrazone compounds, styryl compounds, stilbene compounds, pyrazoline compounds, oxazole compounds, thiazole compounds, and triarylmethane compounds. These charge transporting substances may be used alone or in combination.

Examples of the binder resin used for the charge transporting layer include acrylic resin, methacrylic resin, acrylonitrile resin, allyl resin, alkyd resin, epoxy resin, silicone resin, phenolic resin, phenoxy resin, butyral resin, polyacrylamide, polyacetal, polyamide-imide, polyamide, polyallyl ether, polyarylate, polyimide, polyurethane, polyester, polyethylene, polycarbonate, polystyrene, polysulfone, polyvinyl butyral, polyphenylene oxide, polybutadiene, polypropylene, urea resin, vinyl chloride resin, and vinyl acetate resin. Among them, polyarylate and polycarbonate are particularly used.

The ratio of the charge transporting substance to the binder resin is preferably 2:1 to 1:2 by mass.

The thickness of the charge transporting layer is preferably 5 to 50 μm and more preferably 7 to 30 μm.

Additives such as an antioxidant, an ultraviolet absorber, a plasticizer, fluorine-containing resin particles, and a silicone compound may be added to the charge transporting layer.

In the case where the photosensitive layer is a single-layer photosensitive layer, the photosensitive layer can be formed by applying a photosensitive layer coating solution prepared by dispersing the above-described charge generating substance and charge transporting substance together with the above-described binder resin and solvent and then drying the resultant film.

The thickness of the single-layer photosensitive layer is preferably 5 to 40 μm and more preferably 15 to 30 μm.

In the present invention, the matrix component in the surface layer of the electrophotographic photosensitive member is a component other than rotatably-retained spherical particles in the surface layer, the component shaping pores that rotatably retain the rotatably-retained spherical particles. For example, in the case where the surface layer of the electrophotographic photosensitive member is a charge transporting layer, the above-described binder resin and charge transporting substance constitute the matrix component. When additives other than rotatably-retained spherical particles are added to the charge transporting layer, such additives also constitute the matrix component.

To impart higher durability to the electrophotographic photosensitive member, a curable resin can be used as a resin (binder resin) for the surface layer of the electrophotographic photosensitive member. Examples of the curable resin include thermosetting phenolic resin, melamine resin, urethane resin, epoxy resin, urea resin, unsaturated polyester, siloxane resin obtained by a sol-gel method, thermosetting polyimide, and alkyd resin. Furthermore, a resin obtained by performing a cross-linking reaction on an acrylic compound having an unsaturated bond (a monomer of acrylic resin), a methacrylic compound (a monomer of methacrylic resin), an allyl compound, a vinyl compound, an epoxy compound having a cyclic partial structure, or an oxetane compound using radiant rays such as ultraviolet rays and electron beams can be used. In recent years, a method in which a resin obtained by performing a cross-linking reaction on a compound having a charge transporting structure and a polymerizable functional group such as an acryloyloxy group or a hydroxyl group using heat, ultraviolet rays, or electron beams is used for the surface layer has been proposed to suppress residual charges in the surface layer. Also in the present invention, such a cross-linkable material can be used as a resin (binder resin) of the matrix component in the surface layer of the electrophotographic photosensitive member.

In the case where a cross-linkable material is used for the matrix component in the surface layer and a dehydration-condensation reaction is employed as a cross-linking reaction, the volume of the material shrinks during the cross-linking reaction. Therefore, it is difficult to keep the above-described porosity ((Dm−Dp)/Dp) within a range of 0.05 to 0.65. Thus, when a cross-linkable material is used for the matrix component in the surface layer, a polyaddition reaction or an unsaturated polymerization reaction is particularly employed as the cross-linking reaction.

Additives such as an antioxidant, an ultraviolet absorber, a plasticizer, fluorine-containing resin particles, and a silicone compound may be added to the surface layer of the electrophotographic photosensitive member.

The coating solution for each of the layers can be applied by, for example, dipping (dip coating), spray coating, spinner coating, roller coating, Mayer bar coating, or blade coating. The viscosity of the coating solution is preferably 5 to 500 mPa·s in terms of coatability. The resultant film is generally dried using hot air, but can be irradiated with ultraviolet rays, electron beams, or infrared rays to increase the strength of the layers.

A process cartridge and an electrophotographic apparatus including the electrophotographic photosensitive member of the present invention will now be described.

The process cartridge and electrophotographic apparatus of the present invention each include the electrophotographic photosensitive member of the present invention and a cleaning unit having a cleaning blade that is in contact with the surface of the electrophotographic photosensitive member. Transfer residual toner on the surface of the electrophotographic photosensitive member is removed with the cleaning blade of the cleaning unit. The linear load per unit length in the longitudinal direction in a contact portion between the electrophotographic photosensitive member and the cleaning blade is generally 300 to 1200 mN/cm. Even if the linear load is in such a range, good cleaning property can be achieved by using the electrophotographic photosensitive member of the present invention having high lubricity (low friction) on the surface.

Figure 5:
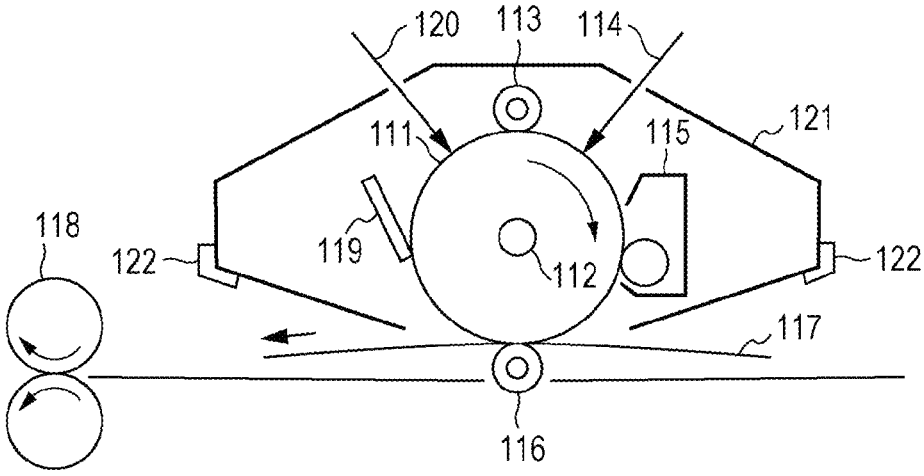
FIG. 5 shows an example of an electrophotographic apparatus equipped with a process cartridge including an electrophotographic photosensitive member.

FIG. 5 schematically shows an example of a structure of an electrophotographic apparatus equipped with a process cartridge including the electrophotographic photosensitive member of the present invention.

In FIG. 5, a cylindrical electrophotographic photosensitive member 111 of the present invention rotates about a shaft 112 at a predetermined peripheral speed in a direction indicated by an arrow in the drawing.

The rotating surface (peripheral surface) of the electrophotographic photosensitive member 111 is positively or negatively charged by a charging unit 113 and is then exposed to exposure light (image exposure light) 114 emitted from an exposure unit (not shown). Thus, an electrostatic latent image of a target image is formed on the surface of the electrophotographic photosensitive member 111. The charging unit may be a corona charging unit that uses, for example, a corotron or a scorotron or a contact charging unit that uses a roller, a brush, or a film. The voltage applied to the charging unit may be a direct-current voltage alone or a direct-current voltage on which an alternating voltage is superimposed. The exposure unit may be a slit exposure unit or a laser beam scanning exposure unit.

The electrostatic latent image formed on the surface of the electrophotographic photosensitive member 111 is developed with toner of a developing unit 115 to form a toner image. For example, development is performed with a magnetic or non-magnetic single-component or two-component toner in a contact manner or in a noncontact manner. Examples of the toner include a polymerized toner produced by suspension polymerization or emulsion polymerization and a spheroidized toner produced by mechanical grinding or spheroidizing. The toner preferably has a weight-average particle size of 4 to 7 μm and an average circularity of 0.95 to 0.99.

The toner image formed on the surface of the electrophotographic photosensitive member 111 is sequentially transferred to a medium (e.g., paper sheet) 117 by a transfer unit 116. The medium 117 is fed by a medium supply unit (not shown) to a portion (contact portion) between the electrophotographic photosensitive member 111 and the transfer unit 116 in synchronism with the rotation of the electrophotographic photosensitive member 111.

The medium 117 to which the toner image has been transferred is separated from the surface of the electrophotographic photosensitive member 111. The toner image is then fixed by a fixing unit 118. The image-formed medium (print or copy) is then outputted from the electrophotographic apparatus.

After the toner image has been transferred, transfer residual toner on the surface of the electrophotographic photosensitive member 111 is removed with a cleaning blade 119 of a cleaning unit. The electricity on the surface of the electrophotographic photosensitive member 111 is then removed with preexposure light 120 emitted from a preexposure unit (not shown). Thus, the electrophotographic photosensitive member 111 is used for image formation in a repeated manner.

Two or more constituting units selected from the electrophotographic photosensitive member 111, the charging unit 113, the developing unit 115, the transfer unit 116, and the cleaning blade 119 of the cleaning unit may be housed in a container to constitute a process cartridge. The process cartridge may be detachably attached to a main body of an electrophotographic apparatus. In FIG. 5, the electrophotographic photosensitive member 111, the charging unit 113, the developing unit 115, and the cleaning blade 119 of the cleaning unit are integrated into a process cartridge 121, which is detachable from the main body of an electrophotographic apparatus through a guide unit 122, such as a rail, of the main body of an electrophotographic apparatus.

A structure of an intermediate transfer member will now be described using, as an example, a belt-shaped intermediate transfer member (hereinafter also referred to as "intermediate transfer belt") including a base layer and a surface layer.

The base layer can be formed of a resin and a conductive agent.

Examples of the resin used for the base layer include curable resins and thermoplastic resins such as polyimide, polyamide-imide, polyether ether ketone, polyphenylene sulfide, and polyester. These resins may be used alone or in combination as a mixture or a copolymer.

Examples of the conductive agent used for the base layer include electron conduction substances such as carbon black, antimony-doped tin oxide, titanium oxide, and conductive polymers; and ionic conduction substances such as sodium perchlorate and lithium perchlorate. Furthermore, cationic or anionic surfactants, nonionic surfactants, and oligomers and polymers having an oxyalkylene repeating unit can also be used as the conductive agent.

The volume resistivity of the base layer is preferably $1.0\times10^{7}$ to $1.0\times10^{12}$ Ω·cm. The surface resistivity of the base layer is preferably $1.0\times10^{8}$ to $1.0\times10^{14}$ Ω/square. By setting the volume resistivity of the base layer in the range above, the charge-up in continuous operation and image defects caused by lack of a transfer bias can be suppressed. By setting the surface resistivity of the base layer in the range above, separating discharge caused when a medium is separated from an intermediate transfer member (intermediate transfer belt) and image defects caused by scattering of toner can be suppressed.

As described above, the surface layer can be formed using a surface layer coating solution containing a matrix component and rotatably-retained spherical particles.

As in the case of the electrophotographic photosensitive member, the matrix component in the surface layer of the intermediate transfer member is a component other than rotatably-retained spherical particles in the surface layer, the component shaping pores that rotatably retain the rotatably-retained spherical particles.

The above-described characteristics (volume resistivity and surface resistivity) of the base layer also apply to the entire intermediate transfer member (intermediate transfer belt) obtained by forming a surface layer on the base layer. Therefore, the surface layer can contain the same conductive agent as that of the base layer.

The surface layer of the intermediate transfer member is a layer located on the outermost surface side of the intermediate transfer member (a layer having a surface on which toner is carried). For example, in the case of an intermediate transfer member including two or more layers, a layer located on the outermost surface side among the two or more layers is the surface layer of the intermediate transfer member. In the case of an intermediate transfer member including a single layer, the single layer is the surface layer of the intermediate transfer member.

Figure 8:
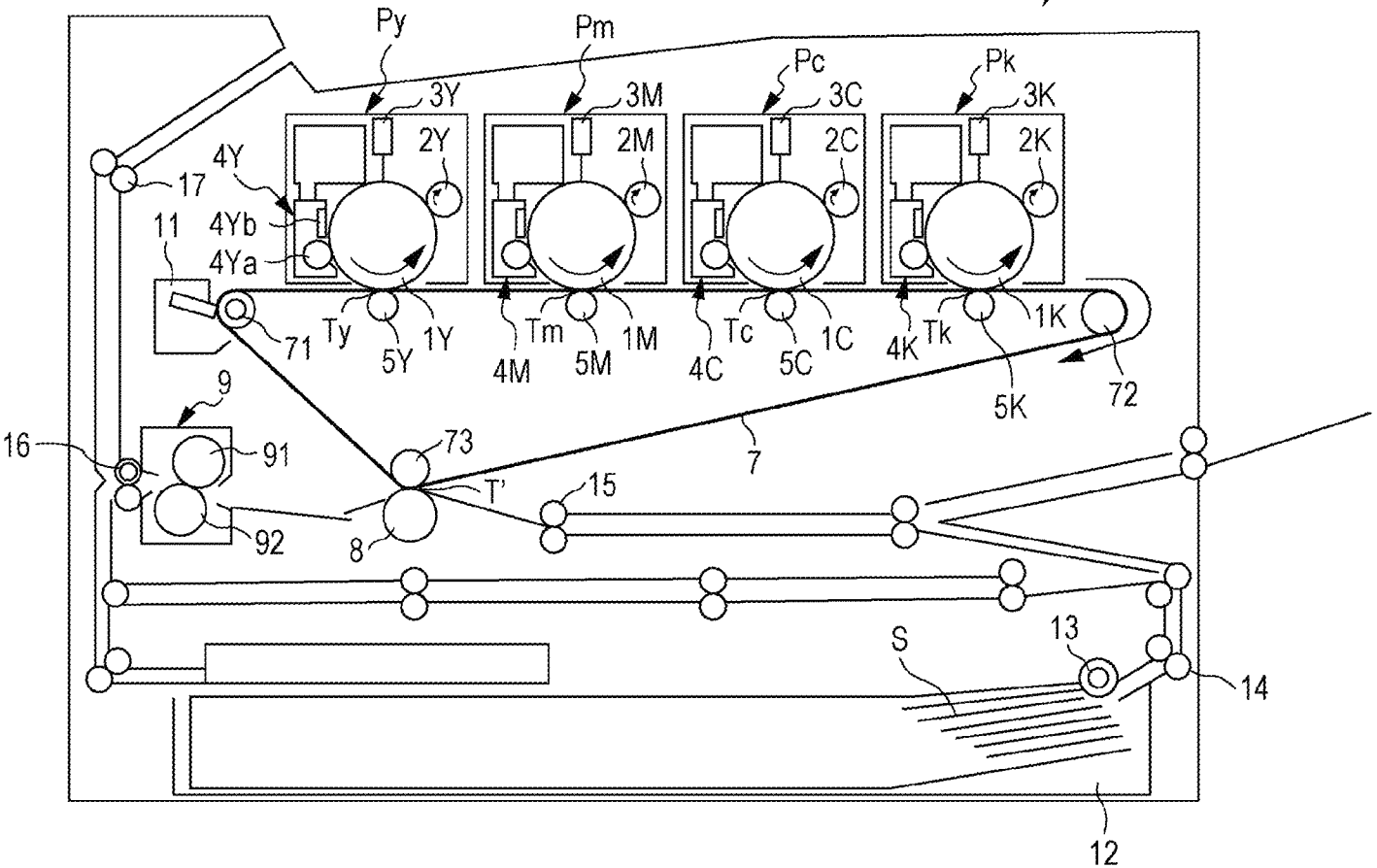
FIG. 8 shows an example of an electrophotographic apparatus including an intermediate transfer member.

FIG. 8 schematically shows an example of a structure of an electrophotographic apparatus including the intermediate transfer member of the present invention.

In FIG. 8, a belt-shaped intermediate transfer member (intermediate transfer belt) 7 of the present invention is stretched by a driving roller 71, a tension roller 72, and a driven roller 73 and rotates at a predetermined peripheral speed in a direction indicated by an arrow in the drawing.

Along a planar portion of the intermediate transfer member 7, image forming units Py, Pm, Pc, and Pk serving as image forming portions for respective color components yellow (Y), magenta (M), cyan (C), and black (K) are disposed in that order in a direction in which the surface of the intermediate transfer member 7 moves. Since the basic structures of the image forming units are the same, the details of only the image forming unit Py for a yellow component will be described below.

The yellow image forming unit Py includes a cylindrical electrophotographic photosensitive member 1Y.

The yellow image forming unit Py also includes a charging unit 2Y. The surface (peripheral surface) of the electrophotographic photosensitive member 1Y is positively or negatively charged by the charging unit 2Y. An exposure unit 3Y is disposed above the electrophotographic photosensitive member 1Y. An electrostatic latent image of the yellow component is formed on the surface of the charged electrophotographic photosensitive member 1Y by the exposure unit 3Y. The charging unit may be a corona charging unit that uses, for example, a corotron or a scorotron or a contact charging unit that uses a roller, a brush, or a film. The voltage applied to the charging unit may be a direct-current voltage alone or a direct-current voltage on which an alternating voltage is superimposed. The exposure unit may be a slit exposure unit or a laser beam scanning exposure unit.

The electrostatic latent image formed on the surface of the electrophotographic photosensitive member 1Y is developed with a yellow toner of a developing unit 4Y to form a yellow toner image. The developing unit 4Y includes a developing roller 4Ya serving as a developer-carrying member and a regulating blade 4Yb serving as a developer amount regulation member and contains a yellow toner. The developing roller 4Ya to which the yellow toner has been supplied is lightly in contact with the electrophotographic photosensitive member 1Y in a developing portion and rotates in a direction in which the electrophotographic photosensitive member 1Y rotates at a speed different from that of the electrophotographic photosensitive member 1Y. The yellow toner conveyed to the developing portion by the developing roller 4Ya is attached to the electrostatic latent image formed on the surface of the electrophotographic photosensitive member 1Y by applying a developing bias to the developing roller 4Ya.

The yellow toner image that has reached a first transfer portion Ty is transferred (first transferred) to the surface of the intermediate transfer member 7 by a first transfer unit (first transfer roller) 5Y.

The operation described above is also performed in each of the image forming units Pm, Pc, and Pk for magenta (M), cyan (C), and black (K) as the intermediate transfer member 7 rotates. Consequently, a yellow toner image, a magenta toner image, a cyan toner image, and a black toner image are superimposed on the surface of the intermediate transfer member 7. In a second transfer portion T', a toner image obtained by superimposing the four-color toner images is transferred (second transferred) to a medium (e.g., paper sheet) S by a second transfer unit (second transfer roller) 8. The medium S is stored in a cassette 12 serving as a medium-storing unit, separately supplied into the electrophotographic apparatus by a pick-up roller 13, and fed to the second transfer portion T' by a pair of conveying rollers 14 and a pair of registration rollers 15 in synchronism with the rotation of the intermediate transfer member 7.

The medium S to which the toner image has been transferred is separated from the surface of the intermediate transfer member 7 and introduced into a fixing unit 9. In the fixing unit 9, the toner image is fixed. The fixing unit 9 includes a fixing roller 91 equipped with a heater and a pressure roller 92. The toner image is fixed on the medium S by heating and pressurizing an unfixed toner image on the medium S. The medium S is outputted from the electrophotographic apparatus by a pair of conveying rollers 16 and a pair of discharge rollers 17 as an image-formed medium (print or copy).

A cleaning blade 11 of a cleaning unit for the intermediate transfer member 7 is disposed on the downstream side of the second transfer portion T' in the rotational direction of the intermediate transfer member 7. Transfer residual toner (second transfer residual toner) left on the surface of the intermediate transfer member 7 without being transferred (second transferred) to the medium S is removed by the cleaning blade 11.

Note that the electrophotographic photosensitive member of the present invention can be used as each of the electrophotographic photosensitive members 1Y, 1M, 1C, and 1K.

EXAMPLES

The present invention will now be further described in detail based on Examples. However, the present invention is not limited to Examples. In Examples, "part" means "part by mass".

Example 1

An aluminum cylinder having a diameter of 30 mm and a length of 260 mm was used as a support.

Next, 50 parts of titanium oxide particles each coated with tin oxide that contains 10% by mass of antimony oxide, 25 parts of resole phenolic resin, 30 parts of methoxypropanol, 30 parts of methanol, and 0.002 parts of silicone oil (polydimethylsiloxane-polyoxyalkylene copolymer with a weight-average molecular weight of 3000) were dispersed for 2 hours with a sand mill that uses glass beads having a diameter of 1 mm to prepare a conductive layer coating solution. The conductive layer coating solution was applied onto the support by dip coating, and the resultant film was cured at 140° C. for 20 minutes to form a conductive layer having a thickness of 20 μm.

Subsequently, 5 parts of N-methoxymethylated 6-nylon was dissolved in 95 parts of methanol to prepare an undercoating layer coating solution. The undercoating layer coating solution was applied onto the support by dip coating, and the resultant film was dried at 100° C. for 20 minutes to form an undercoating layer having a thickness of 0.5 μm.

Next, 10 parts of a hydroxygallium phthalocyanine crystal (charge generating substance) having strong peaks at Bragg angles (2θ±0.2°) of 7.5°, 9.9°, 12.5°, 16.3°, 18.6°, 25.1°, and 28.3° in the X-ray diffraction spectrum measured using a CuKα characteristic X-ray, 0.1 parts of a compound represented by the structural formula (2) below, 5 parts of polyvinyl butyral (product name: S-LEC BX-1 manufactured by Sekisui Chemical Co., Ltd.), and 250 parts of cyclohexanone were inserted into a sand mill that uses glass beads having a diameter of 1 mm and dispersed for one hour. Subsequently, 250 parts of ethyl acetate was added thereto to prepare a charge-generating-layer coating solution. The charge-generating-layer coating solution was applied onto the undercoating layer by dip coating, and the resultant film was dried at 100° C. for 10 minutes to form a charge generating layer having a thickness of 0.16 μm.

[Chem. 1]

(2)

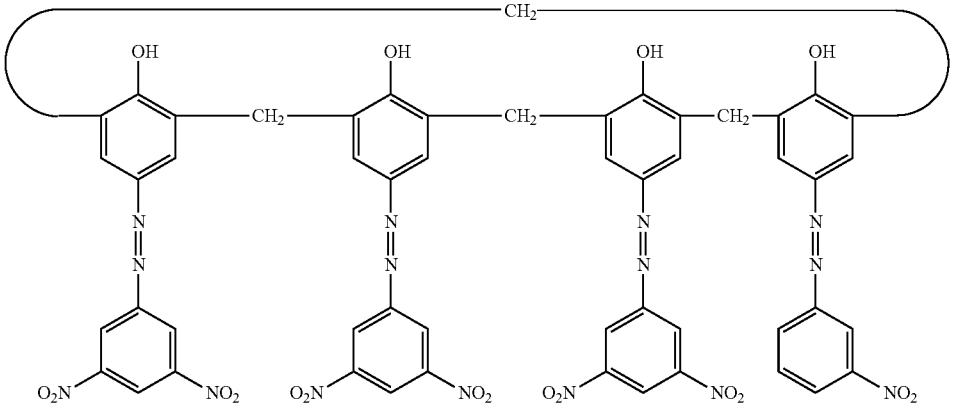

Next, 40 parts of a compound (charge transporting substance) represented by the structural formula (3) below, 5 parts of a compound (charge transporting substance) represented by the structural formula (4) below, and 50 parts of polyarylate (weight-average molecular weight: 115000, molar ratio of terephthalic acid skeleton to isophthalic acid skeleton: 50/50) having a structural unit represented by the structural formula (5) below were dissolved in 300 parts of monochlorobenzene to prepare a charge-transporting-substance-dissolved solution. Furthermore, 100 parts of monochlorobenzene and 10 parts of spherical polymethylsilsesquioxane particles (product name: Tospearl 145 manufactured by Toshiba Silicone Co., Ltd.) that were organic/inorganic hybrid particles and had an average particle size of 4.5 μm were inserted into a paint shaker and dispersed for three hours to prepare a spherical particle dispersion liquid. The charge-transporting-substance-dissolved solution and the spherical particle dispersion liquid were mixed with each other under stirring to prepare a charge-transporting-layer coating solution. The charge-transporting-layer coating solution was applied onto the charge generating layer by dip coating, and the resultant film was dried at 120° C. for one hour to form a charge transporting layer having a thickness of 25 μm. The surface of the charge transporting layer was then treated with a hydrofluoric acid solution having a concentration of 20 mass % to obtain an electrophotographic photosensitive member in which the charge transporting layer was a surface layer.

[Chem. 2]

(3)

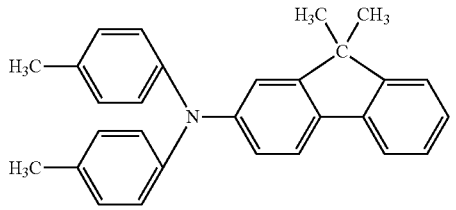

[Chem. 3]

(4)

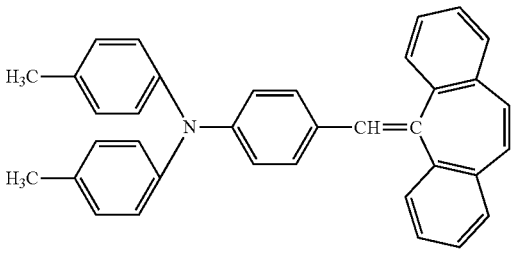

[Chem. 4]

(5)

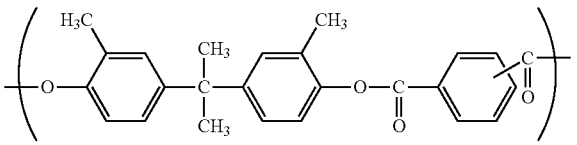

Figure 6:
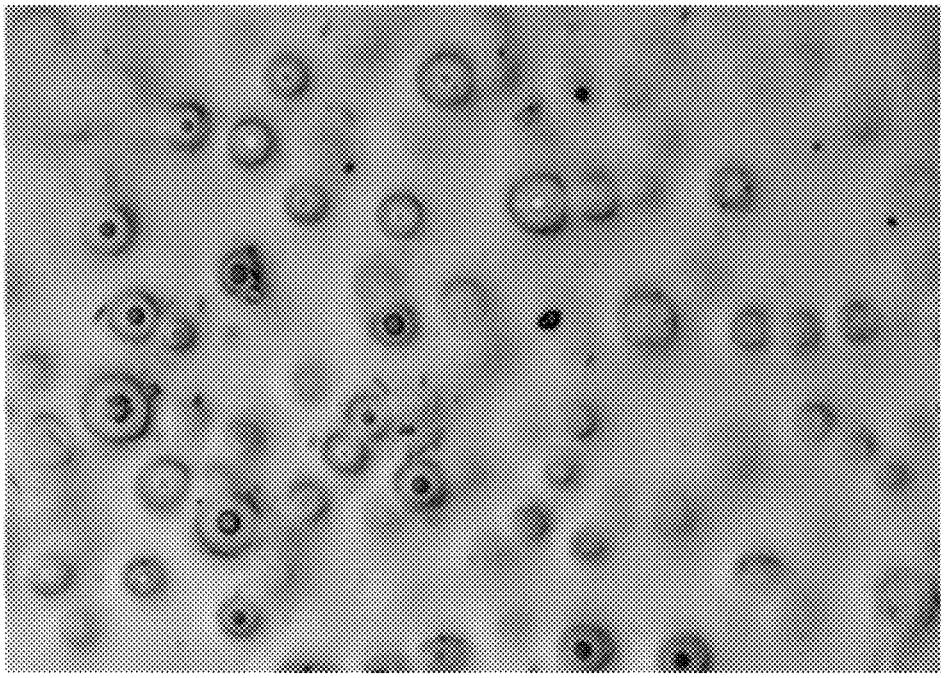
FIG. 6 is a micrograph of a surface of an electrophotographic photosensitive member before a treatment with hydrofluoric acid.
Figure 7:
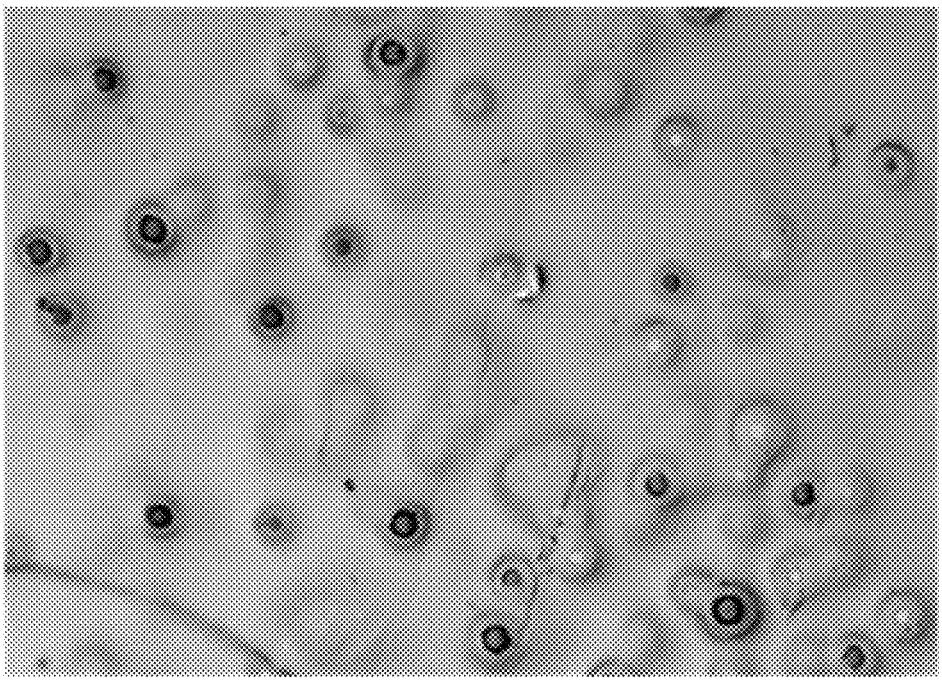
FIG. 7 is a micrograph of a surface of an electrophotographic photosensitive member after a treatment with hydrofluoric acid.

FIG. 6 is a micrograph of the surface of an electrophotographic photosensitive member before the treatment with hydrofluoric acid. FIG. 7 is a micrograph of the surface of an electrophotographic photosensitive member after the treatment with hydrofluoric acid. Before the treatment with hydrofluoric acid, spherical particles (rotatably-retained spherical particles) were bound with a matrix component. On the other hand, after the treatment with hydrofluoric acid, spherical particles were not bound with a matrix component and there were many spherical particles (rotatably-retained spherical particles) having a gap between the outer surface of each of the rotatably-retained spherical particles and the inner surface of the corresponding pore in the matrix component.

The produced electrophotographic photosensitive member was installed in an evaluation apparatus below, and images were formed to evaluate output images. The evaluation with actual equipment was performed in a high-temperature and high-humidity (32.5° C./85% RH) environment.

First, the produced electrophotographic photosensitive member was installed in a process cartridge for a laser beam printer (LBP) (product name: Laser Jet 4300n (monochrome machine)) manufactured by Hewlett Packard Development Company, L.P. An image was outputted on 2000 sheets (durability test) using the LBP, and the presence or absence of blade curling and blade chattering was evaluated for the first five sheets (beginning) and the last five sheets (end of durability test).

Next morning, a halftone image was outputted on 10 sheets to evaluate the presence or absence of image deletion.

The electrophotographic photosensitive member with which the evaluation above had been performed was installed in a laser beam printer (LBP) (product name: Laser Jet 4600 (color machine)) manufactured by Hewlett Packard Development Company, L.P. Herein, the linear load per unit length in the longitudinal direction in a contact portion between the electrophotographic photosensitive member and a cleaning blade was set to be 750 mN/cm. The application of a lubricant to a cleaning blade, which is performed in Laser Jet 4600, was not performed. The toner used was prepared by suspension polymerization. The toner had a weight-average particle size of 5.0 μm and an average circularity of 0.985. Under these conditions, an image was outputted on 50 sheets and the cleaning state was confirmed to evaluate the presence or absence of passing toner. Table 2 shows the evaluation results.

Comparative Example 1

An electrophotographic photosensitive member was produced and evaluated in the same manner as in Example 1, except that spherical polymethylsilsesquioxane particles were not used when the charge-transporting-layer coating solution was prepared in Example 1. Table 2 shows the evaluation results.

Comparative Example 2

An electrophotographic photosensitive member was produced and evaluated in the same manner as in Example 1, except that the surface of the charge transporting layer was not treated with a hydrofluoric acid solution in Example 1. Table 2 shows the evaluation results. In Comparative Example 2, since the treatment with a hydrofluoric acid solution was not performed, polymethylsilsesquioxane particles were bound with the matrix component.

Examples 2 and 3

Electrophotographic photosensitive members were produced and evaluated in the same manner as in Example 1, except that the polymethylsilsesquioxane particles having an average particle size of 4.5 μm and used when the charge-transporting-layer coating solution was prepared in Example 1 were changed to spherical polymethylsilsesquioxane particles having an average particle size of 2 μm and spherical polymethylsilsesquioxane particles having an average particle size of 11 μm, respectively. Table 2 shows the evaluation results.

Example 4

An electrophotographic photosensitive member was produced and evaluated in the same manner as in Example 1, except that the polymethylsilsesquioxane particles having an average particle size of 4.5 μm and used when the charge-transporting-layer coating solution was prepared in Example 1 were changed to spherical silica particles having an average particle size of 0.3 μm, which were inorganic particles.

Examples 5 and 6

Electrophotographic photosensitive members were produced and evaluated in the same manner as in Example 4, except that the spherical silica particles having an average particle size of 0.3 μm and used when the charge-transporting-layer coating solution was prepared in Example 4 were changed to spherical silica particles having an average particle size of 1.0 μm and spherical silica particles having an average particle size of 2 μm, respectively. Table 2 shows the evaluation results.

Example 7

The production of an electrophotographic photosensitive member was performed until the formation of the charge transporting layer in the same manner as in Comparative Example 1. Subsequently, 8 parts of a compound (a monomer of methacrylic resin) represented by the structural formula (6) below, 2 parts of spherical polymethylsilsesquioxane particles (product name: Tospearl 145 manufactured by Toshiba Silicone Co., Ltd.) that were organic/inorganic hybrid particles and had an average particle size of 4.5 μm, and 40 parts of ethanol were inserted into a paint shaker and dispersed for two hours to prepare a protective layer coating solution. The protective layer coating solution was applied onto the charge transporting layer by dip coating, and the resultant film was irradiated with electron beams in a nitrogen atmosphere to cure the film. Thus, a cross-linked protective layer was formed. Subsequently, the surface of the protective layer was treated with a hydrofluoric acid solution having a concentration of 20 mass % to obtain an electrophotographic photosensitive member in which the protective layer was a surface layer. The produced electrophotographic photosensitive member was evaluated in the same manner as in Comparative Example 1. Table 2 shows the evaluation results.

[Chem. 5]

(6)

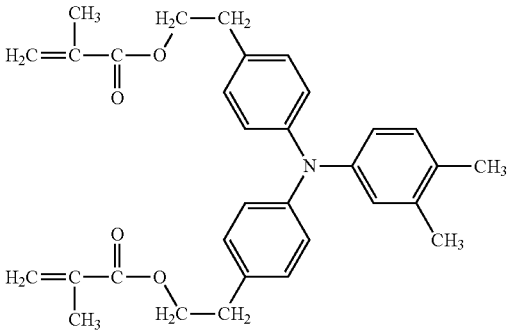

Example 8

An electrophotographic photosensitive member was produced and evaluated in the same manner as in Comparative Example 2, except that the spherical polymethylsilsesquioxane particles having an average particle size of 4.5 μm and used when the charge-transporting-layer coating solution was prepared in Comparative Example 2 were changed to spherical silica particles having an average particle size of 3 μm and subjected to surface modification with silicone, and 3 parts of silicone oil (product name: KF-96 manufactured by Shin-Etsu Chemical Co., Ltd.) having a viscosity of 200 cs was added to the charge-transporting-layer coating solution. Table 2 shows the evaluation results. In Example 8, the surface of the charge transporting layer was not treated with a hydrofluoric acid solution, but silica particles subjected to surface modification with silicone were used and a silicone oil was added to the charge-transporting-layer coating solution. Therefore, spherical silica particles were not bound with the matrix component.

Example 9

An electrophotographic photosensitive member was produced and evaluated in the same manner as in Example 7, except that the spherical polymethylsilsesquioxane particles having an average particle size of 4.5 μm and used when the protective layer coating solution was prepared in Example 7 were changed to spherical silica particles having an average particle size of 3 μm and subjected to surface modification with silicone, 1 part of silicone oil (product name: KF-96 manufactured by Shin-Etsu Chemical Co., Ltd.) having a viscosity of 200 cs was added to the protective layer coating solution, and the surface of the protective layer was not treated with a hydrofluoric acid solution. Table 2 shows the evaluation results. In Example 9, the surface of the protective layer was not treated with a hydrofluoric acid solution, but silica particles subjected to surface modification with silicone were used and a silicone oil was added to the protective layer coating solution. Therefore, spherical silica particles were not bound with the matrix component.

Comparative Example 3

An electrophotographic photosensitive member was produced and evaluated in the same manner as in Example 7, except that spherical polymethylsilsesquioxane particles were not used when the protective layer coating solution was prepared in Example 7. Table 2 shows the evaluation results.

Comparative Example 4

An electrophotographic photosensitive member was produced and evaluated in the same manner as in Example 7, except that the surface of the protective layer was not treated with a hydrofluoric acid solution in Example 7. Table 2 shows the evaluation results. In Comparative Example 4, since the treatment with a hydrofluoric acid solution was not performed, polymethylsilsesquioxane particles were bound with the matrix component.

Table 1 collectively shows the structures of the surface layers of the electrophotographic photosensitive members in Examples 1 to 9 and Comparative Examples 1 to 4.

TABLE 2

| | Beginning | | End of durability test | | | |
|---|---|---|---|---|---|---|
| | | Blade | | Blade | Next morning | |
| | Blade curling | chat-tering | Blade curling | chat-tering | Image deletion | Passing toner |
| Ex. 1 | No | No | No | No | No | No |
| Ex. 2 | No | No | No | No | No | No |
| Ex. 3 | No | No | No | No | No | Slightly Yes |

TABLE 1

| | | Surface layer | | | |
|---|---|---|---|---|---|
| | | Matrix component | | Rotatably-retained spherical particles | Filler in gap between outer surface of rotatably-retained spherical particle and inner surface of pore |
| Ex. 1 | Charge transporting layer | Polyarylate (formula (5)) | Charge transporting substances (formulae (3) and (4)) | Polymethylsilsesquioxane particles | Air |
| Ex. 2 | Charge transporting layer | Polyarylate (formula (5)) | Charge transporting substances (formulae (3) and (4)) | Polymethylsilsesquioxane particles | Air |
| Ex. 3 | Charge transporting layer | Polyarylate (formula (5)) | Charge transporting substances (formulae (3) and (4)) | Polymethylsilsesquioxane particles | Air |
| Ex. 4 | Charge transporting layer | Polyarylate (formula (5)) | Charge transporting substances (formulae (3) and (4)) | Silica particles | Air |
| Ex. 5 | Charge transporting layer | Polyarylate (formula (5)) | Charge transporting substances (formulae (3) and (4)) | Silica particles | Air |
| Ex. 6 | Charge transporting layer | Polyarylate (formula (5)) | Charge transporting substances (formulae (3) and (4)) | Silica particles | Air |
| Ex. 7 | Protective layer | Methacrylic resin (formula (6)) | | Polymethylsilsesquioxane particles | Air |
| Ex. 8 | Charge transporting layer | Polyarylate (formula (5)) | Charge transporting substances (formulae (3) and (4)) | Silica particles subjected to surface modification with silicone | Silicone oil |
| Ex. 9 | Protective layer | Methacrylic resin (formula (6)) | | Silica particles subjected to surface modification with silicone | Silicone oil |
| C.E. 1 | Charge transporting layer | Polyarylate (formula (5)) | Charge transporting substances (formulae (3) and (4)) | None | — |
| C.E. 2 | Charge transporting layer | Polyarylate (formula (5)) | Charge transporting substances (formulae (3) and (4)) | Polymethylsilsesquioxane particles*1 | Close adhesion*2 |
| C.E. 3 | Protective layer | Methacrylic resin (formula (6)) | | None | — |
| C.E. 4 | Protective layer | Methacrylic resin (formula (6)) | | Polymethylsilsesquioxane particles*1 | Close adhesion*2 |

Ex.: Example, C.E.: Comparative Example

*1In Comparative Examples 2 and 4, since the polymethylsilsesquioxane particles were bound with the matrix component, the polymethylsilsesquioxane particles in Comparative Examples 2 and 4 do not correspond to the rotatably-retained spherical particles of the present invention.

*2Since the polymethylsilsesquioxane particles in Comparative Examples 2 and 4 adhered closely to the matrix component, there is no gap between the outer surface of each of the rotatably-retained spherical particles and the inner surface of the corresponding pore in the matrix component and therefore there is no filler in the gap.

TABLE 2-continued

| | Beginning | | End of durability test | | | |
|---|---|---|---|---|---|---|
| | | Blade | | Blade | Next morning | |
| | Blade curling | chat-tering | Blade curling | chat-tering | Image deletion | Passing toner |
| Ex. 4 | No | No | No | Slightly Yes | No | No |
| Ex. 5 | No | No | No | No | No | No |
| Ex. 6 | No | No | No | No | No | No |
| Ex. 7 | No | No | No | No | Slightly Yes | No |
| Ex. 8 | No | No | No | No | No | No |
| Ex. 9 | No | No | No | No | No | No |
| C.E. 1 | Yes | Yes | Yes | Yes | Yes | No |
| C.E. 2 | No | No | No | Yes | Yes | Yes |
| C.E. 3 | No | Yes | Yes | Yes | Yes | Yes |
| C.E. 4 | No | No | No | Yes | Yes | Yes |

Ex.: Example, C.E.: Comparative Example

Example 11

An intermediate transfer belt that was composed of polyimide and provided in a copying machine (product name: iRC 2620) manufactured by CANON KABUSHIKI KAISHA was used as a base layer.

Subsequently, 30 parts of di(trimethylolpropane)tetraacrylate (a monomer of acrylic resin), 4.5 parts of antimony-doped tin oxide particles (SN series manufactured by ISHIHARA SANGYO KAISHA, LTD.), 2 parts of 1-hydroxycyclohexyl phenyl ketone (photoinitiator) (product name: Irgacure 184 manufactured by BASF), 23 parts of methyl ethyl ketone, and 15 parts of ethylene glycol were mixed and dispersed using a mixer homogenizer. The dispersion liquid was then dispersed using a dispersing machine Nanomizer (manufactured by YOSHIDA KIKAI CO., LTD.) to prepare a dispersion liquid A.

Next, 5 parts of spherical silica particles having an average particle size of 2 μm and subjected to surface modification with silicone, 3 parts of silicone oil (viscosity: 200 cs) (product name: KF-96 manufactured by Shin-Etsu Chemical Co., Ltd.), 1 part of a silicone surfactant (product name: KF-6105 manufactured by Shin-Etsu Chemical Co., Ltd.), 20 parts of methyl ethyl ketone, and 3 parts of hexamethyldisiloxane, which was a silicone-based solvent, were mixed and dispersed using a mixer homogenizer to prepare a dispersion liquid B.

The dispersion liquid A was added to the dispersion liquid B. The mixture was mixed and dispersed using a mixer homogenizer and then dispersed using a dispersing machine Nanomizer (manufactured by YOSHIDA KIKAI CO., LTD.) to prepare a surface layer coating solution. The surface layer coating solution was applied onto the base layer, and the resultant film was dried at 100° C. for 5 minutes. After that, the film was irradiated with ultraviolet rays at 500 mJ/cm$^2$ to cure the film. Consequently, a surface layer having a thickness of 5 μm was formed. Thus, a belt-shaped intermediate transfer member was obtained.

The intermediate transfer member had a volume resistivity of $1.8\times10^{10}$ Ω·cm and a surface resistivity of $4.4\times10^{11}$ Ω/square (measured with Hiresta manufacture by Mitsubishi Chemical Corporation).

As a result of the observation of the surface of the intermediate transfer member, the silica particles, which were spherical particles (rotatably-retained spherical particles), were not bound with an acrylic resin, which was a matrix component.

The intermediate transfer member was installed in the copying machine (product name: iRC 2620) manufactured by CANON KABUSHIKI KAISHA, and an image was outputted on 4000 sheets (durability test) in a high-temperature and high-humidity (32.5° C./85% RH) environment.

Next morning, a halftone image was outputted on 10 sheets and then a solid white image was outputted on 100 sheets.

Under the conditions above, the sliding state between the intermediate transfer member and the cleaning blade and the cleaning state were evaluated at the beginning (the first five sheets in a durability test), at the end of a durability test (the last five sheets in a durability test), and next morning. Herein, the linear load per unit length in the longitudinal direction in a contact portion between the intermediate transfer member and the cleaning blade was set to be 580 mN/cm. The application of a lubricant to a cleaning blade, which is performed in iRC 2620, was not performed. Table 3 shows the evaluation results.

Example 12

An intermediate transfer member was produced and evaluated in the same manner as in Example 11, except that 5 parts of the spherical silica particles having an average particle size of 2 μm, subjected to surface modification with silicone, and used when the surface layer coating solution was prepared in Example 11 were changed to 5 parts of spherical polymethylsilsesquioxane particles (product name: Tospearl 120 manufactured by Toshiba Silicone Co., Ltd.) having an average particle size of 2.0 μm. Table 3 shows the evaluation results.

As a result of the observation of the surface of the intermediate transfer member, the polymethylsilsesquioxane particles, which were spherical particles (rotatably-retained spherical particles), were not bound with an acrylic resin, which was a matrix component.

Comparative Example 11

An intermediate transfer member was produced and evaluated in the same manner as in Example 11, except that 5 parts of the spherical silica particles having an average particle size of 2 μm, subjected to surface modification with silicone, and used when the surface layer coating solution was prepared in Example 11 were changed to 5 parts of spherical silica particles that were not subjected to surface modification and had an average particle size of 2 μm, and a silicone oil (product name: KF-96) and a silicone surfactant (product name: KF-6105) were not used. Table 3 shows the evaluation results.

As a result of the observation of the surface of the intermediate transfer member, the silica particles, which were spherical particles (rotatably-retained spherical particles), were bound with an acrylic resin, which was a matrix component.

Comparative Example 12

An intermediate transfer member was produced and evaluated in the same manner as in Example 11, except that 5 parts of the spherical silica particles having an average particle size of 2 μm, subjected to surface modification with silicone, and used when the surface layer coating solution was prepared in Example 11 were not used. Table 3 shows the evaluation results.

TABLE 3

| | Beginning | | End of durability test | | Next morning | | |
|---|---|---|---|---|---|---|---|
| | Blade curling | Blade chattering | Blade curling | Blade chattering | Blade curling | Blade chattering | Passing toner |
| Ex. 11 | No | No | No | No | No | No | No |
| Ex. 12 | No | No | No | No | No | No | No |
| C.E. 11 | No | No | No | No | No | Yes | Yes |
| C.E. 12 | No | No | No | Slightly Yes | No | Yes | Yes |

Ex.: Example, C.E.: Comparative Example

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-139548 filed Jun. 23, 2011 and No. 2012-113640 filed May 17, 2012, which are hereby incorporated by reference herein in their entirety.

The invention claimed is:

1. An electrophotographic photosensitive member comprising:
- a surface layer containing
  - a matrix component; and
  - a rotatably-retained spherical particle that is not bound with the matrix component and is rotatably retained in a pore in the matrix component, and
- the rotatably-retained spherical particle
  - protruding from the surface of the electrophotographic photosensitive member, and
  - having a diameter of from 0.3 to 10 μm.

2. The electrophotographic photosensitive member according to claim 1, wherein a gap between an outer surface of the rotatably-retained spherical particle and an inner surface of the pore is filled with a liquid.

3. The electrophotographic photosensitive member according to claim 1, wherein the rotatably-retained spherical particle is a silica particle or a polymethylsilsesquioxane particle.

4. The electrophotographic photosensitive member according to claim 1, wherein the rotatably-retained spherical particle is a silica particle, and a gap between an outer surface of the rotatably-retained spherical particle and an inner surface of the pore is filled with a silicone oil.

5. The electrophotographic photosensitive member according to claim 1, wherein the matrix component contains polyarylate or methacrylic resin.

6. A process cartridge detachably attached to a main body of an electrophotographic apparatus, the process cartridge integrally supporting the electrophotographic photosensitive member according to claim 1 and a cleaning unit including a cleaning blade that is in contact with a surface of the electrophotographic photosensitive member, and
- in the contact portion of the rotatably-retained spherical particle and the cleaning blade, a state in which the rotatably-retained spherical particle rolls being maintained.

7. The process cartridge according to claim 6, wherein a linear load per unit length in a longitudinal direction in a contact portion between the electrophotographic photosensitive member and the cleaning blade is 300 to 1200 mN/cm.

8. An electrophotographic apparatus comprising:
- the electrophotographic photosensitive member according to claim 1;
- a charging unit;
- an image exposure unit;
- a developing unit;
- a transfer unit; and
- a cleaning unit including a cleaning blade that is in contact with a surface of the electrophotographic photosensitive member, and
- in the contact portion of the rotatably-retained spherical particle and the cleaning blade, a state in which the rotatably-retained spherical particle rolls being maintained.

9. The electrophotographic apparatus according to claim 8, wherein a linear load per unit length in a longitudinal direction in a contact portion between the electrophotographic photosensitive member and the cleaning blade is 300 to 1200 mN/cm.

10. An intermediate transfer member comprising:
- a surface layer containing
  - a matrix component; and
  - a rotatably-retained spherical particle that is not bound with the matrix component and is rotatably retained in a pore in the matrix component, and
- the rotatably-retained spherical particle
  - protruding from the surface of the intermediate transfer member, and
  - having a diameter or from 0.3 to 10 μm.

11. The intermediate transfer member according to claim 10, wherein a gap between an outer surface of the rotatably-retained spherical particle and an inner surface of the pore is filled with a liquid.

12. The intermediate transfer member according to claim 10, wherein the rotatably-retained spherical particle is a silica particle or a polymethylsilsesquioxane particle.

13. The intermediate transfer member according to claim 10, wherein the rotatably-retained spherical particle is a silica particle, and a gap between an outer surface of the rotatably-retained spherical particle and an inner surface of the pore is filled with a silicone oil.

14. The intermediate transfer member according to claim 10, wherein the matrix component contains polyarylate or methacrylic resin.

15. An electrophotographic apparatus comprising:
- an electrophotographic photosensitive member;
- an image exposure unit;
- a developing unit;
- a first transfer unit;
- the intermediate transfer member according to claim 10;
- a second transfer unit; and
- a cleaning unit including a cleaning blade that is in contact with a surface of the intermediate transfer member, and
- in the contact portion of the rotatably-retained spherical particle and the cleaning blade, a state in which the rotatably-retained spherical particle rolls being maintained.

16. The electrophotographic apparatus according to claim 15, wherein a linear load per unit length in a longitudinal direction in a contact portion between the intermediate transfer member and the cleaning blade is 300 to 1200 mN/cm.

* * * * *